US010036233B2

(12) United States Patent
Tang et al.

(10) Patent No.: US 10,036,233 B2
(45) Date of Patent: Jul. 31, 2018

(54) METHOD AND SYSTEM FOR AUTOMATICALLY ADJUSTING ONE OR MORE OPERATIONAL PARAMETERS IN A BOREHOLE

(71) Applicants: Weiting Tang, Tomball, TX (US); Blake C. Burnette, Tomball, TX (US); William D. Holcomb, The Woodlands, TX (US); Scott G. Nelson, Cypress, TX (US); Yong N. Kang, Houston, TX (US)

(72) Inventors: Weiting Tang, Tomball, TX (US); Blake C. Burnette, Tomball, TX (US); William D. Holcomb, The Woodlands, TX (US); Scott G. Nelson, Cypress, TX (US); Yong N. Kang, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 284 days.

(21) Appl. No.: 14/601,711

(22) Filed: Jan. 21, 2015

(65) Prior Publication Data

US 2016/0208595 A1 Jul. 21, 2016

(51) Int. Cl.

| | |
|---|---|
| ***G05B 13/00*** | (2006.01) |
| ***G01V 1/40*** | (2006.01) |
| ***G01M 15/00*** | (2006.01) |
| ***E21B 41/00*** | (2006.01) |

(52) U.S. Cl.

CPC ..... *E21B 41/00* (2013.01)

(58) Field of Classification Search

CPC ..... G05B 15/02

USPC ..... 700/275

See application file for complete search history.

(56) References Cited

U.S. PATENT DOCUMENTS

| | | | | |
|---|---|---|---|---|
| 4,901,563 | A | 2/1990 | Pearson | |
| 6,393,906 | B1 | 5/2002 | Vityk et al. | |
| 7,051,808 | B1 | 5/2006 | Vinegar et al. | |
| 7,890,307 | B2 | 2/2011 | Geehan et al. | |
| 8,211,296 | B2 | 7/2012 | Angelilli et al. | |
| 8,812,334 | B2 * | 8/2014 | Givens | G06Q 10/06 166/250.16 |
| 9,442,217 | B2 * | 9/2016 | Pomerantz | E21B 49/082 |

(Continued)

OTHER PUBLICATIONS

Stephenson, et al., "Fracturing Process Control and Automation: Phase 2"; SPE 26220, SPE Petroleum Computer Conference, New Orleans, LA, Jul. 11-14, 1993, 7 pages.

(Continued)

*Primary Examiner* — Suresh Suryawanshi
(74) *Attorney, Agent, or Firm* — Cantor Colburn LLP

(57) ABSTRACT

An embodiment of a method of performing an energy industry operation includes: collecting historical data relating to one or more previously performed operations having a characteristic common to both the one or more previously performed operations and a proposed operation; planning the proposed operation based on the historical data, the proposed operation associated with one or more operational parameters; performing the proposed operation; measuring a condition during performance of the proposed operation and comparing the measured condition to the historical data; and automatically adjusting the one or more operational parameters based on the comparison.

20 Claims, 3 Drawing Sheets

(56) References Cited

U.S. PATENT DOCUMENTS

| | | | | |
|---|---|---|---|---|
| 9,598,947 | B2 * | 3/2017 | Wang | E21B 44/00 |
| 2004/0182573 | A1 | 9/2004 | Gunawardana et al. | |
| 2006/0102342 | A1 | 5/2006 | East et al. | |
| 2007/0137859 | A1 | 6/2007 | Abass et al. | |
| 2007/0185696 | A1 * | 8/2007 | Moran | E21B 44/00 703/10 |
| 2009/0020284 | A1 * | 1/2009 | Graf | E21B 44/00 166/250.15 |
| 2009/0194273 | A1 | 8/2009 | Surjaatmadja et al. | |
| 2010/0218941 | A1 | 9/2010 | Ramurthy et al. | |
| 2011/0120702 | A1 | 5/2011 | Craig | |
| 2011/0127038 | A1 | 6/2011 | Mack et al. | |
| 2011/0272144 | A1 | 11/2011 | Belcher et al. | |
| 2012/0203525 | A1 * | 8/2012 | Rodriguez Herrera | E21B 47/022 703/2 |
| 2013/0032335 | A1 | 2/2013 | Bennett | |
| 2014/0019052 | A1 * | 1/2014 | Zaeper | G01V 11/002 702/8 |
| 2014/0083687 | A1 | 3/2014 | Poe et al. | |
| 2014/0121972 | A1 * | 5/2014 | Wessling | E21B 41/00 702/6 |
| 2015/0027212 | A1 * | 1/2015 | Fadlun | G05B 23/0216 73/112.05 |
| 2015/0185363 | A1 * | 7/2015 | Herbig | E21B 49/003 702/6 |
| 2015/0205002 | A1 * | 7/2015 | Liang | G01V 1/303 703/2 |
| 2015/0226645 | A1 * | 8/2015 | Seo | G05B 23/0227 702/182 |
| 2016/0160627 | A1 * | 6/2016 | Aitken | G05B 13/048 700/90 |
| 2017/0152728 | A1 * | 6/2017 | Abou-Sayed | E21B 41/0057 |

OTHER PUBLICATIONS

Tomlinson, H.L., et al. "Fracturing Process Control and Automation"; SPE 17315, SPE Permian Basin Oil and Gas Recovery Conference, Midland, TX, Mar. 10-11, 1986, 8 pages.

* cited by examiner

METHOD AND SYSTEM FOR AUTOMATICALLY ADJUSTING ONE OR MORE OPERATIONAL PARAMETERS IN A BOREHOLE

BACKGROUND

Hydrocarbon exploration and energy industries employ various systems and operations to accomplish activities including drilling, formation evaluation, stimulation and production. Measurements such as pressure, temperature and flow rate are typically performed to monitor and assess such operations. During such operations, problems or situations may arise that can have a detrimental effect on the operation, equipment and/or safety of field personnel. Control of the operation to avoid such problems is important, specifically to avoid creating conditions that could potentially lead to the problems.

SUMMARY

An embodiment of a method of performing an energy industry operation includes: collecting historical data relating to one or more previously performed operations having a characteristic common to both the one or more previously performed operations and a proposed operation; planning the proposed operation based on the historical data, the proposed operation associated with one or more operational parameters; performing the proposed operation; measuring a condition during performance of the proposed operation and comparing the measured condition to the historical data; and automatically adjusting the one or more operational parameters based on the comparison.

An embodiment of a system for performing an energy industry operation includes: a carrier configured to be disposed in a borehole in an earth formation, the carrier connected to a device for performing the energy industry operation; and a processor configured to collect historical data relating to one or more previously performed operations having a characteristic common to both the one or more previously performed operations and a proposed operation. The processor is configured to perform: planning the proposed operation based on the historical data, the proposed operation associated with one or more operational parameters; receiving measurement data, the measurement data associated with a condition measured during performance of the proposed operation; comparing the measurement data to the historical data; and automatically adjusting the one or more operational parameters based on the comparison.

BRIEF DESCRIPTION OF THE DRAWINGS

The following descriptions should not be considered limiting in any way. With reference to the accompanying drawings, like elements are numbered alike.

DETAILED DESCRIPTION

The systems and methods described herein provide for planning, controlling and/or analyzing an energy industry operation using historical data collected from one or more previous operations. Data collected from prior operations is referred to herein as "historical data." The historical data is used, in one embodiment, to plan and/or improve plans for a prospective operation. Lessons learned from the historical data may be used in planning the operation and providing guidance during the operation. Types of historical data include, e.g., chemical information, completion data, perforation cluster data and production data.

The historical data is collected from prior operations having similarities or common characteristics with the current or proposed operation. Such common characteristics include, for example, the location and/or type of formation, and the type of operation performed. In one embodiment, the historical data is stored in one or more storage locations, and a subset of the data relating to operations having common characteristics is collected for use in planning and/or controlling the proposed or current operation.

For example, for a proposed or current hydraulic fracturing operation to be performed in a hydrocarbon-bearing reservoir, historical data is collected from one or more databases storing data from other operations executed in the same reservoir or similar reservoirs. Similar operations are selected (e.g., operations performed in other wellbore locations in the same or a similar reservoir), where data related to those similar operations had been collected, and the collected data is analyzed for use in planning and/or controlling the current operation.

In one embodiment, the historical data is analyzed to set up guidelines or rules for performing the operation and/or for preventing dangerous or undesirable conditions. These rules may be used during planning the operation to set up operational parameters (e.g., pump pressure and flow rate), and may also be used during the operation to identify conditions that could lead to equipment failure, danger to personnel on the well-site or other undesirable situations.

The descriptions provided herein are applicable to various oil and gas or energy industry data, activities, or operations. Although embodiments herein are described in the context of stimulation and completion operations, they are not so limited. The embodiments may be applied to any energy industry operation. Examples of energy industry operations include surface or subsurface measurement and modeling, reservoir characterization and modeling, formation evaluation (e.g., pore pressure, lithology, fracture identification, etc.), stimulation (e.g., hydraulic fracturing, acid stimulation, sand control, and gravel pack operations), drilling, completion and production.

Figure 1:
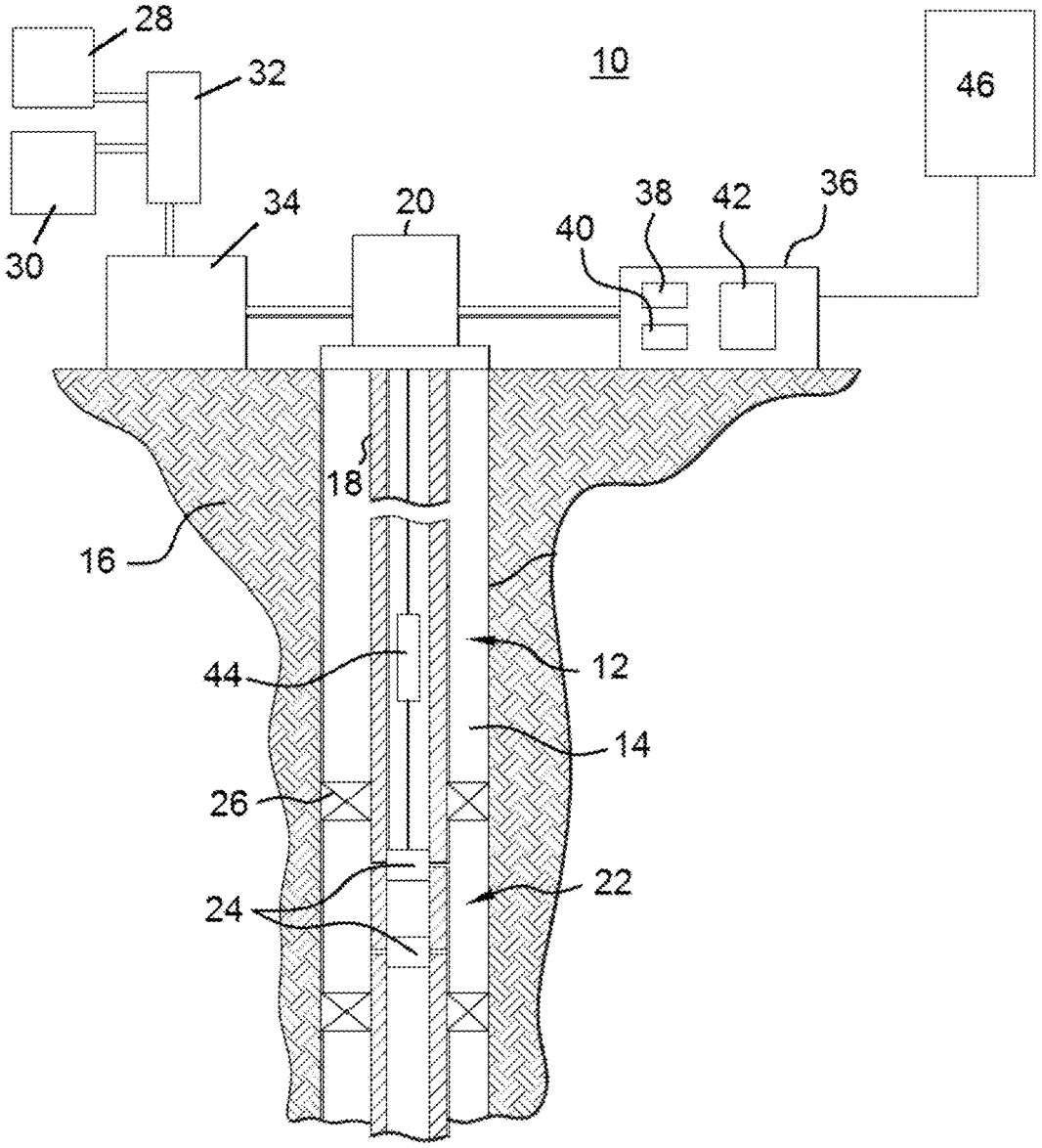
FIG. 1 depicts an embodiment of a downhole fluid injection system.

Referring to FIG. 1, an exemplary embodiment of a hydrocarbon production and/or stimulation system 10 includes a borehole string 12 configured to be disposed in a borehole 14 that penetrates at least one earth formation 16. The borehole may be an open hole, a cased hole or a partially cased hole. In one embodiment, the borehole string 12 is a stimulation or injection string that includes a tubular 18, such as a pipe (e.g., multiple pipe segments) wired pipe or coiled tubing, that extends from a wellhead 20 at a surface location (e.g., at a drill site or offshore stimulation vessel).

The system 10 includes one or more stimulation assemblies 22 configured to control injection of stimulation fluid and direct hydraulic fracturing or other stimulation fluid into one or more production zones in the formation. Each stimulation assembly 22 includes one or more injection or flow control devices 24 configured to direct stimulation fluid from a conduit in the tubular 18 to the borehole 14. As used herein, the term "fluid" or "fluids" includes liquids, gases, hydrocarbons, multi-phase fluids, mixtures of two of more fluids, fresh water, non-fresh water, and fluids injected from the surface, such as water, brine water, or stimulation fluids. For example, the fluid may be a slurry that includes fracturing or stimulation fluids and proppants. In another example, the fluid is a stimulation fluid such as an acid stimulation fluid.

Other components that may be incorporated include perforations in the casing and/or borehole (e.g., incorporated in a frac sleeve), and packers 26, which are typically conveyed downhole and activated to expand when they reach a selected depth to seal the borehole and create isolated regions. Multiple openings and packers can be disposed at multiple depths to create a plurality of isolated regions or zones.

Various surface devices and systems can be included at surface locations. For example, a fluid storage unit 28, a proppant storage unit 30, a mixing unit 32, and a pump or injection unit 34 (e.g., one or more high pressure pumps for use in stimulation and/or fracturing) are connected to the wellhead 20 for providing fluid to the borehole string 12 for operations such as a hydraulic fracturing operation, a stimulation operation, a cleanout operation and others.

The system 10 also includes a surface processing unit such as a control unit 36, which typically includes a processor 38, one or more computer programs 40 for executing instructions, and a storage device 42. The control unit 36 receives signals from downhole sensors and surface devices such as the mixing unit 32 and the pumping unit 34, and controls the surface devices to obtain a selected parameter of the fluid at a downhole location. Functions such as sensing and control functions may not be exclusively performed by the surface controller 36. For example, a downhole electronics unit 44 is connected to downhole sensors and devices and performs functions such as controlling downhole devices, receiving sensor data and communication, and communicating with the controller 36.

The controller 36 may be in communication with other processors, users and storage locations in order to, e.g., send and receive data relating to a current operation or past operations. For example, the controller 36 is connected (e.g., via a network or the Internet) to one or more remote storage locations 46. An example of such a location is a database configured to store data collected from multiple energy industry operations performed in the formation and/or in formations located in other geographical regions.

Various sensing or measurement devices may be included in the system 10, in downhole and/or surface locations. For example, one or more parameter sensors (or sensor assemblies such as LWD subs) are configured for formation evaluation measurements relating to the formation, borehole, geophysical characteristics and/or borehole fluids. These sensors may include formation evaluation sensors (e.g., resistivity, dielectric constant, water saturation, porosity, density and permeability), sensors for measuring geophysical parameters (e.g., acoustic velocity and acoustic travel time), and sensors for measuring borehole fluid parameters (e.g., viscosity, density, clarity, rheology, pH level, and gas, oil and water contents).

The sensor devices, electronics, tools and other downhole components may be included in or embodied as a BHA, drill string component or other suitable carrier. A "carrier" as described herein means any device, device component, combination of devices, media and/or member that may be used to convey, house, support or otherwise facilitate the use of another device, device component, combination of devices, media and/or member. Exemplary non-limiting carriers include drill strings of the coiled tubing type, of the jointed pipe type and any combination or portion thereof. Other carrier examples include casing pipes, wirelines, wireline sondes, slickline sondes, drop shots, downhole subs, bottom-hole assemblies, and drill strings.

Figure 2:
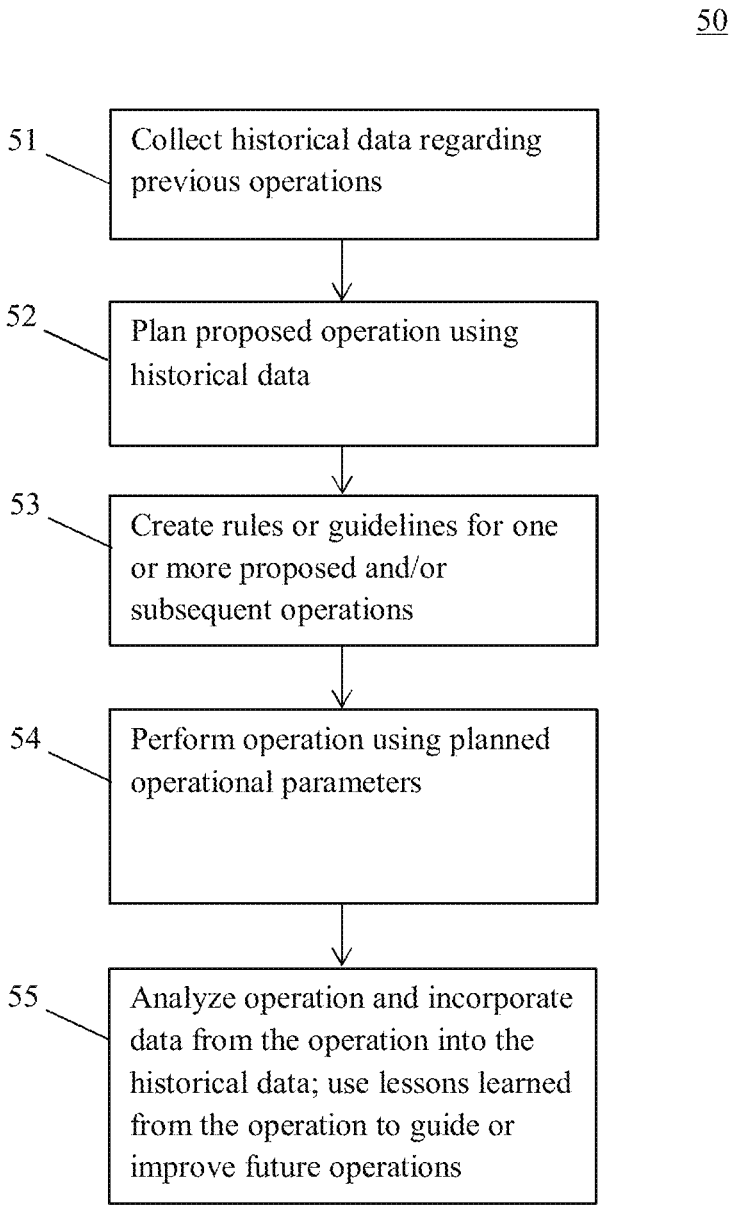
FIG. 2 is a flow chart providing an exemplary method of planning and/or controlling an energy industry operation

FIG. 2 illustrates a method 50 for planning, performing and/or evaluating an energy industry operation. The method may be performed by one or more processors or processing units (e.g., the control unit 36) that are configured to receive information and plan, control and/or monitor energy industry operations. The method 50 includes one or more of stages 51-55 described herein. In one embodiment, the method 50 includes the execution of all of stages 51-55 in the order described. However, certain stages 51-55 may be omitted, stages may be added, or the order of the stages changed.

In one embodiment, the method is performed as specified by an algorithm that allows a processor (e.g., the control unit 36) to plan an operation, set rules for an operation, automatically adjust or tune an operation model, provide status information and/or control aspects of the operation. The processor as described herein may be a single processor or multiple processors (e.g., a network).

In the first stage 51, historical data describing aspects of previous operations is collected. The historical data is used to inform and/or improve one or more planned or proposed operations. Lessons learned from the previous operations may be utilized to improve planning.

The historical data may be used to summarize an effective way to operate equipment and control operational parameters during the proposed operation, and/or to identify any conditions or equipment behaviors that could cause equipment failures or other problems.

The historical data includes information relating to previous operations. This data includes, for example, information regarding the location and characteristics (e.g., lithology and reservoir fluid properties) of formations in which the previous operations were performed. Other examples include records of the operational parameters (e.g., fluid types, fluid pressures and flow rates) used during the previous operations, records of conditions measured during the previous operations (e.g., pump pressures, borehole pressures, and borehole temperatures recorded over time), and descriptions of events encountered during the operations. Such events may include any events that had a negative impact on the operation, e.g., proppant screen-outs, equipment damage, excessive pump or borehole pressures and others. The historical data may be any information relating to previous operations, and is not limited to the specific examples or types of data described herein.

In one embodiment, historical data is collected for previous operations having one or more common or similar characteristics relative to one another and/or relative to a proposed operation. Such common characteristics include, for example, the location and/or type of formation, and the type of operation performed. For stimulation operations, the common characteristics may include whether the operation is an original stimulation operation or a re-stimulation (e.g., a re-frac operation).

The historical data may also relate to individual perforation clusters in the borehole of the proposed operation or in other boreholes. For example, information relating to individual perforation clusters is analyzed or processed In one embodiment, the historical data is collected from a library or database that includes data relating to other operations. For example, a library of borehole treatment execution data for a plurality of operations is accessed. Operations having common characteristics with the proposed operation are selected, and the associated data is collected as a subset of the library data.

In the second stage 52, an energy industry operation is planned or proposed. The proposed operation is planned by selecting or proposing operational parameters over a planned time period during which the operation is to be performed. Such parameters include, for example, injection fluid type, injection pressures, proppant types and concentrations, types of equipment and amount of time needed. In one embodiment, the operation is a fluid injection operation, such as a stimulation, fracturing, clean-out or production operation.

For example, a hydraulic fracturing stimulation treatment is planned, and operational parameters are selected. The operational parameters include the equipment used, fracturing fluid properties, parameters relating to perforation, planned fluid injection pressures and flow rates, and others.

In addition to selecting operational parameters, information regarding various properties of the environment ("environmental parameters") are estimated or acquired. Such properties include formation lithology, other formation properties (e.g., permeability), formation fluid properties, downhole pressure and temperature, borehole size and trajectory, and others. The environmental parameters may be used to assist in planning the operation.

Planning the operation may include generating a mathematical model that simulates aspects of planned operation. Such models include, for example, an operation model that simulates various operational parameters and conditions (surface and/or downhole) as a function of time and/or depth. The model receives information describing the downhole environment and operational parameters. Based on this information and the operational parameters, the model predicts the values of various conditions over the course of the operation. Such conditions include, for example, borehole pressure, downhole fluid properties, production fluid properties, and others. The model may be generated prior to the operation, and adjusted during the operation as measurements of various conditions are performed.

In one embodiment, the planning includes processing the historical data to recognize patterns in conditions (e.g., pressure and/or temperature) over time that may allow for prediction of events and outcomes of the proposed operation. For example, previous operations that encountered problems (e.g., relating to equipment failure or excessive pressure) are analyzed to recognize patterns in the conditions leading up to the problems. These patterns are used in monitoring the proposed operation when performed and/or to create rules or guidelines to apply to the proposed operation.

Various predictive analytic techniques may be used by the processor to plan the operation and/or recognize patterns. Examples of such predictive analytics include artificial intelligence techniques (e.g., machine learning), predictive models, decision models, and regression techniques.

In the third stage 53, in one embodiment, the historical data is used to create rules or guidelines for the proposed operation and any future similar operations. The rules may be applied to the operation so that pumps or other equipment is automatically operated according to the rules.

In one embodiment, analysis of the historical data is performed in order to form a standard guideline or set of rules for operation of various equipment for future operations. For example, the predictive analytics and/or pattern detection described above is used to select a maximum pump pressure and/or injection fluid flow rate, breakdown detection threshold, screen-out prevention threshold, or set a maximum rate at which pump pressures can be increased.

In the fourth stage 54, the operation is performed. During the operation, various parameters or conditions are measured, which may be utilized during the operation to control or improve operational performance, and/or may be used after the operation to assess the results of the operation.

For a fluid stimulation operation, measured conditions may include one or more of tool depth, tripping speed or rate of penetration, downhole pressure, downhole temperature, downhole fluid properties, produced fluid properties, fluid flow rates, and operational parameters (e.g., pump pressures and flow rates, deployment speed, etc.)

For example, the operation is monitored and real time data is collected using surface and/or downhole acquisition devices or systems. One or more processors or controllers receive the real time data from surface and/or downhole measurement devices. Based on the real time data, the processor may provide alerts or information to an operator, perform automatic adjustments to the operation, and/or collect information regarding the operation.

During the operation, in one embodiment, monitoring is performed in order to guide equipment operation and prevent dangerous conditions or situations from occurring. For example, frac pumps are controlled by a user or the processor, during which parameters such as borehole pressure and pump pressure are measured. Analysis of previous operations provides guidance regarding pressure levels or gradients (pressure changes over time) that have negatively affected operations in the past. If such levels or gradients are detected, the processor may send an alert, provide guidance to the user, or automatically adjust or shut down the operation to prevent equipment damage or danger to operators.

In the fifth stage 55, collected information regarding the operation is used to analyze the effectiveness of the operation and learn lessons for future operations. These lessons may be applied to future operations (e.g., a future operation is performed according to the method 80 using lessons from the current operation and/or other operations).

Figure 3:
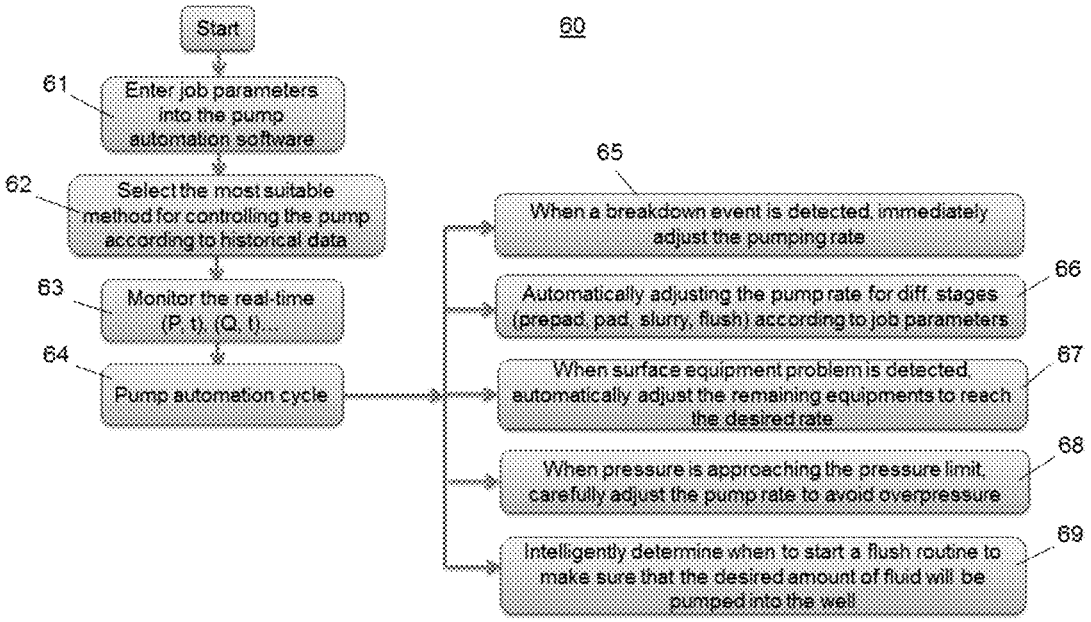
FIG. 3 is a flow chart showing an exemplary method of controlling an operation based on historical data.

FIG. 3 illustrates an example of a method 60 of performing an operation using historical data. In this example, a hydraulic fracturing job is performed. This example is described for illustrative purposes and is not intended to be limiting, as various types of operations can be controlled using the methods described herein. The method 60 may include all of the steps or stages discussed below (illustrated as blocks 61-69) or may include any subset of the steps.

As shown in block 61, job parameters are entered into a pump control processor or controller, which is running pump automation software. Exemplary job parameters include borehole and formation characteristics or properties, and amounts and types of proppant and injection fluid. At block 62, the processor selects the most suitable method for controlling a pump according to historical data, by selecting operational parameters such as pump pressure and pumping rate. At block 63, the operation is monitored by measuring parameters such as pressure over time (P,t) and flow rate as a function of time (Q,t). The processor performs a pump automation cycle at block 64, in which the processor controls the operation and automatically responds to various conditions detected during the monitoring. The processor can response in real time so that any undesirable conditions can be immediately or quickly remedied, and/or so that the operation can be improved or optimized in real time. One or more of the exemplary control processes described below are based on analysis of historical data in conjunction with measurements performed during the operation.

For example, the processor immediately adjusts the pumping rate in response to detection of a breakdown event (block 65), and automatically adjusts the pumping rate for different stages of the operation (block 66). Exemplary stages include injection of pre-pad and pad fluids, injection of slurry including fluid and proppant, and flush stages. If surface equipment problems are detected, the processor may automatically adjust other equipment as necessary to achieve the desired pumping rate or other operational parameter (block 67). If or when the measured pressure approaches a selected pressure limit (e.g., selected based on historical data), the processor automatically adjusts the pumping rate to avoid overpressure (block 68). The processor may also determine when to start a flush routine to make sure that the desired amount of fluid will be pumped into the well (block 69).

The systems and methods described herein provide various advantages over prior art techniques. Embodiments provide a way to monitor operations, control operations in a beneficial way based on lessons learned from previous operations, and improve operational effectiveness and safety. Standard guidelines or operation specific guidance or rules can be set up in order to provide intelligent pump control, avoid operator errors, and prevent damaging or dangerous situations from occurring.

For example, embodiments described herein provide a way to improve fluid injection operations (e.g., fracturing operations) so that such operation can be performed more efficiently and effectively. Such improvements include providing intelligent control of frac pumps, to improve well performances and reduce job problems due to operator lack of experience or other causes.

Normally, the high pressure pumps used in a hydraulic fracturing job are operated and controlled by human operators. Experience levels of the pump operators can have a significant impact on the execution of the hydraulic fracturing stimulation treatment. Inexperienced or undertrained equipment operators might not take the best course of action when presented with a particular circumstance, which could impact the stimulation treatment and ultimately the performance of the well. Embodiments described herein compensate for this by providing for an automatic pump control system that is capable of learning best practices from a historical database (e.g., a database of similar jobs) so that proper execution decisions are made.

Generally, some of the teachings herein are reduced to an algorithm that is stored on machine-readable media. The algorithm is implemented by a computer or processor such as the control unit 36, and provides operators with desired output.

In support of the teachings herein, various analyses and/or analytical components may be used, including digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A method of performing an energy industry operation, comprising:

collecting historical data relating to one or more previously performed operations having a characteristic common to both the one or more previously performed operations and a proposed operation;

planning the proposed operation based on the historical data, the proposed operation associated with one or more operational parameters, and generating an operational plan prior to performing the proposed operation, the operational plan including a limit of the one or more operational parameters;

performing the proposed operation, wherein performing the proposed operation includes disposing a downhole component in a borehole in an earth formation and controlling the one or more operational parameters based on the operational plan and the operational parameter limit;

measuring a condition during performance of the proposed operation and comparing the measured condition to the historical data; and automatically adjusting the one or more operational parameters based on the comparison.

2. The method of claim 1, wherein collecting includes accessing a database of energy industry data taken from a plurality of operations, and identifying a subset of the plurality of operations having the common characteristic.

3. The method of claim 1, wherein the common characteristic includes at least one of: geographic location, formation characteristics, type of operation, type of equipment used, and operational parameters.

4. The method of claim 1, wherein the historical data includes measurements of operational parameters and conditions taken during the one or more previously performed operations.

5. The method of claim 1, wherein planning includes recognizing a pattern in the historical data, associating the pattern with an event having an impact on an operation, and creating guidelines for performance of the proposed operation based on the pattern.

6. The method of claim 5, wherein comparing includes comparing the pattern in the historical data to a pattern in the measured condition.

7. The method of claim 5, wherein the one or more previous operations and the proposed operation include injecting fluid into a borehole, and the pattern includes at least one of a pattern of fluid pressure values and a pattern of temperatures measured during the one or more previously performed operations.

8. The method of claim 1, wherein planning the proposed operation includes creating one or more rules to be followed during performance of the proposed operation.

9. The method of claim 8, wherein adjusting includes automatically controlling the proposed operation by a processor based on the comparison and the one or more rules.

10. The method claim 1, wherein planning includes applying predictive analytics to the historical data to identify patterns in the historical data associated with a problem that occurred in one or more of the previously performed operations.

11. A system for performing an energy industry operation, comprising:

a carrier configured to be disposed in a borehole in an earth formation, the carrier connected to a device for performing the energy industry operation; and a processor configured to collect historical data relating to one or more previously performed operations having a characteristic common to both the one or more previously performed operations and a proposed operation; the processor configured to perform:

planning the proposed operation based on the historical data, the proposed operation associated with one or more operational parameters, and generating an operational plan prior to performing the proposed operation, the operational plan including a limit of the one or more operational parameters;

performing the proposed operation, wherein performing includes disposing the carrier in the borehole and controlling the one or more operational parameters by the device based on the operational plan and the operational parameter limit;

receiving measurement data, the measurement data associated with a condition measured during performance of the proposed operation;

comparing the measurement data to the historical data; and automatically adjusting the one or more operational parameters based on the comparison.

12. The system of claim 11, wherein collecting includes accessing a database of energy industry data taken from a plurality of operations, and identifying a subset of the plurality of operations having the common characteristic.

13. The system of claim 11, wherein the common characteristic includes at least one of: geographic location, formation characteristics, type of operation, type of equipment used, and operational parameters.

14. The system of claim 11, wherein the historical data includes measurements of operational parameters and conditions taken during the one or more previously performed operations.

15. The system of claim 11, wherein planning includes recognizing a pattern in the historical data, associating the pattern with an event having an impact on an operation, and creating guidelines for performance of the proposed operation based on the pattern.

16. The system of claim 15, wherein comparing includes comparing the pattern in the historical data to a pattern in the measured condition.

17. The system of claim 15, wherein the one or more previous operations and the proposed operation include injecting fluid into a borehole, and the pattern includes at least one of a pattern of fluid pressure values and a pattern of temperatures measured during the one or more previously performed operations.

18. The system of claim 11, wherein planning the proposed operation includes creating one or more rules to be followed during performance of the proposed operation.

19. The system of claim 18, wherein adjusting includes automatically controlling the proposed operation by the processor based on the comparison and the one or more rules.

20. The system claim 11, wherein planning includes applying predictive analytics to the historical data to identify patterns in the historical data associated with a problem that occurred in one or more of the previously performed operations.

* * * * *